US007151347B1

(12) United States Patent
Myneni et al.

(10) Patent No.: US 7,151,347 B1
(45) Date of Patent: Dec. 19, 2006

(54) PASSIVATED NIOBIUM CAVITIES

(75) Inventors: Ganapati Rao Myneni, Yorktown, VA (US); Bjorgvin Hjorvarsson, Lagga Arby (SE); Gianluigi Ciovati, Newport News, VA (US)

(73) Assignee: Jefferson Science Associates LLC, Newport News, VA (US)

( * ) Notice: Subject to any disclaimer, the term of this patent is extended or adjusted under 35 U.S.C. 154(b) by 36 days.

(21) Appl. No.: 11/168,198

(22) Filed: Jun. 28, 2005

(51) Int. Cl.
*H01J 25/00* (2006.01)
*H01J 25/10* (2006.01)

(52) U.S. Cl. ..... 315/500; 315/5.41

(58) Field of Classification Search ..... 315/500, 315/505, 5.41, 5.42
See application file for complete search history.

(56) References Cited

U.S. PATENT DOCUMENTS 3,784,452 A * 1/1974 Martens et al. ..... 205/51
3,939,053 A * 2/1976 Diepers et al. ..... 204/212
4,014,765 A * 3/1977 Roth et al. ..... 205/651
4,072,588 A * 2/1978 Diepers ..... 205/650
5,306,406 A * 4/1994 Palmieri et al. ..... 204/192.24
6,097,153 A * 8/2000 Brawley et al. ..... 315/5.41

* cited by examiner

*Primary Examiner*—Trinh Vo Dinh

(57) ABSTRACT

A niobium cavity exhibiting high quality factors at high gradients is provided by treating a niobium cavity through a process comprising: 1) removing surface oxides by plasma etching or a similar process; 2) removing hydrogen or other gases absorbed in the bulk niobium by high temperature treatment of the cavity under ultra high vacuum to achieve hydrogen outgassing; and 3) assuring the long term chemical stability of the niobium cavity by applying a passivating layer of a superconducting material having a superconducting transition temperature higher than niobium thereby reducing losses from electron (cooper pair) scattering in the near surface region of the interior of the niobium cavity. According to a preferred embodiment, the passivating layer comprises niobium nitride (NbN) applied by reactive sputtering.

16 Claims, No Drawings

PASSIVATED NIOBIUM CAVITIES

The United States of America may have certain rights to this invention under Management and Operating Contract No. DE-AC05-84ER 40150 from the Department of Energy.

FIELD OF THE INVENTION

The present invention relates to the niobium cavities for use in particle accelerators and the like apparatus and more particularly to such cavities having a passivated interior surface.

BACKGROUND OF THE INVENTION

In the prior art, niobium cavities are the building blocks of particle accelerators, free electron laser and the like apparatus and are well known and commonly used in the operation of such devices. Such niobium cavities are fabricated from high purity niobium sheet or cast plate, via deep drawing, e-beam welding and chemical surface cleaning to obtain high accelerating gradients and quality factors. Often the quality factors at high gradients degrade over time for cavities produced by these methods. Such degradation appears to be affected by adherent surface oxide layers, trapped hydrogen and/or interactions between interstitial oxygen and hydrogen in the niobium material. The release of oxygen, hydrogen or the reaction products of these materials results in degradation of the vacuum within the niobium cavities thereby negatively affecting the quality of the output of such cavities.

There therefore exists a need for niobium cavity that does not exhibit the negative effects caused by the release of such gases or gaseous products under ultra high vacuum conditions.

OBJECT OF THE INVENTION

It is therefore an object of the present invention to provide a niobium cavity for use under ultra high vacuum conditions that does not exhibit vacuum quality degradation due to the release of surface or interstitial quantities of oxygen, hydrogen or the reaction products of these elements.

SUMMARY OF THE INVENTION

According to the present invention, a niobium cavity exhibiting high quality factors at high gradients is provided by treating a niobium cavity through a process comprising: 1) removing surface oxides by plasma etching or a similar process; 2) removing gases absorbed in the bulk niobium by high temperature treatment of the cavity under ultra high vacuum to achieve hydrogen outgassing; and 3) assuring the long term chemical stability of the niobium cavity by applying a passivating layer of a superconducting material having a superconducting transition temperature higher than niobium thereby reducing losses from electron (cooper pair) scattering in the near surface region of the interior of the niobium cavity. According to a preferred embodiment, the passivating layer comprises niobium nitride (NbN) applied by reactive sputtering.

DETAILED DESCRIPTION

While each of the steps in the preparation of the passivated niobium cavities described herein are generally well known and their practice well within the capabilities of the skilled practitioners in these arts, it is their combination to provide a passivated niobium cavity that exhibits high quality factors at high gradients thereby reducing heat loads upon the cryogenic systems used to maintain appropriate conditions in the niobium cavities during operation.

The first step in the preparation of the enhanced niobium cavities of the present invention involves the removal of any oxides from the interior surface of the niobium cavity. While this may be achieved using a variety of techniques, that preferred in the practice of the instant invention involves the plasma treatment of the interior of the niobium cavity using an atmosphere of pure argon, nitrogen or the like inert gas as the carrier. The implementation of such plasma treatment techniques is well known in the art and no detailed description thereof is presented herein, it being well within the capabilities of the skilled artisan to perform such a treatment. Suffice it to say that the plasma treatment must of such a duration and under conditions as to result in the virtually complete removal of any residual oxides or the like that may remain on the interior surface of the cavity after conventional fabrication and cleaning.

The second step in the preparation of the enhanced niobium cavity as described herein involves the removal of hydrogen or other gases absorbed in the bulk of the niobium. Removal of such gases is performed by heating the cavity to an elevated temperature under an ultra high vacuum and retaining such conditions for a period sufficient to allow for migration of contained hydrogen from the niobium bulk and removal thereof from the niobium cavity. Generally, heating of the niobium cavity to a temperature of between about 600 and 900° C. and applying a vacuum on the order of less than about −6 mbar for a period of several hours has proven adequate to obtain such outgassing of entrained hydrogen.

The final step in the preparation of the enhanced niobium cavities of the present invention comprises the application of a passivating layer of a superconducting material exhibiting a superconducting transition temperature higher than that of niobium. Application of the passivating layer is obtained by depositing such a layer by the reactive sputtering using conventional techniques well known and commonly practced by those skilled the reactive sputtering arts. According to a highly preferred embodiment of the present invention, the applied passivating layer comprises niobium nitride (NbN) and is applied by the reactive sputtering of a mixture of nitrogen and argon gas inside of the previously deoxidized and outgassed niobium cavity.

There has thus been described a method for the production of niobium cavities that demonstrate high quality factors at high gradients. Such a process comprises: the plasma deoxidation of the interior surface of the cavity; the removal of hydrogen or other gases that may be entrained in the bulk of the niobium through temperature and vacuum driven outgassing and the application of a passivating layer of a material having a superconducting transition temperature higher than that of niobium.

As the invention has been described, it will be apparent to those skilled in the art that the same may be varied in many ways without departing from the spirit and scope of the invention. Any and all such modifications are intended to be included within the scope of the appended claims.

What is claimed is:

1. A process for the production of a niobium cavity exhibiting high quality factors at high gradients comprising:

A) removing surface oxides from the interior of the niobium cavity;

B) removing gases absorbed in the bulk niobium by high temperature treatment of the cavity under high vacuum to achieve hydrogen outgassing; and C) assuring the long term chemical stability of the niobium cavity by applying a passivating layer of a superconducting material having a superconducting transition temperature higher than that of niobium.

2. The method of claim 1 wherein the removal of surface oxides is accomplished by plasma treatment under a vacuum.

3. The method of claim 1 wherein the removal of gases is accomplished by heating the cavity to a temperature of between about 600 and 900° C. under a vacuum below about −6 mbar.

4. The method of claim 2 wherein the removal of gases is accomplished by heating the cavity to a temperature of between about 600 and 900° C. under a vacuum below about −6 mbar.

5. The method of claim 1 wherein the passivating layer of a superconducting material having a superconducting transition temperature higher than niobium is applied by the reactive sputtering of a mixture of nitrogen and argon to obtain a passivating layer of niobium nitride.

6. The method of claim 2 wherein the passivating layer of a superconducting material having a superconducting transition temperature higher than niobium is applied by the reactive sputtering of a mixture of nitrogen and argon to obtain a passivating layer of niobium nitride.

7. The method of claim 3 wherein the passivating layer of a superconducting material having a superconducting transition temperature higher than niobium is applied by the reactive sputtering of a mixture of nitrogen and argon to obtain a passivating layer of niobium nitride.

8. The method of claim 4 wherein the passivating layer of a superconducting material having a superconducting transition temperature higher than niobium is applied by the reactive sputtering of a mixture of nitrogen and argon to obtain a passivating layer of niobium nitride.

9. A niobium cavity exhibiting high quality factors at high gradients prepared by a process comprising:

A) removing surface oxides from the interior of the niobium cavity;

B) removing gases absorbed in the bulk niobium by high temperature treatment of the cavity under high vacuum to achieve hydrogen outgassing; and C) assuring the long term chemical stability of the niobium cavity by applying a passivating layer of a superconducting material having a superconducting transition temperature higher than that of niobium.

10. The niobium cavity of claim 9 wherein the removal of surface oxides is accomplished by plasma treatment under a vacuum.

11. The niobium cavity of claim 9 wherein the removal of gases is accomplished by heating the cavity to a temperature of between about 600 and 900° C. under a vacuum below about −6 mbar.

12. The niobium cavity of claim 10 wherein the removal of gases is accomplished by heating the cavity to a temperature of between about 600 and 900° C. under a vacuum below about −6 mbar.

13. The niobium cavity of claim 9 wherein the passivating layer of a superconducting material having a superconducting transition temperature higher than niobium is applied by the reactive sputtering of a mixture of nitrogen and argon to obtain a passivating layer of niobium nitride.

14. The niobium cavity of claim 10 wherein the passivating layer of a superconducting material having a superconducting transition temperature higher than niobium is applied by the reactive sputtering of a mixture of nitrogen and argon to obtain a passivating layer of niobium nitride.

15. The niobium cavity of claim 11 wherein the passivating layer of a superconducting material having a superconducting transition temperature higher than niobium is applied by the reactive sputtering of a mixture of nitrogen and argon to obtain a passivating layer of niobium nitride.

16. The niobium cavity of claim 12 wherein the passivating layer of a superconducting material having a superconducting transition temperature higher than niobium is applied by the reactive sputtering of a mixture of nitrogen and argon to obtain a passivating layer of niobium nitride.

* * * * *